US008985361B2

(12) United States Patent
Wilson

(10) Patent No.: US 8,985,361 B2
(45) Date of Patent: Mar. 24, 2015

(54) INTEGRATED LID FOR CANNING JAR

(71) Applicant: DR Enterprises, L.L.C., Nampa, ID (US)

(72) Inventor: Dena Wilson, Nampa, ID (US)

(73) Assignee: DR Enterprises, L.L.C., Nampa, ID (US)

( * ) Notice: Subject to any disclaimer, the term of this patent is extended or adjusted under 35 U.S.C. 154(b) by 0 days.

(21) Appl. No.: 13/760,677

(22) Filed: Feb. 6, 2013

(65) Prior Publication Data

US 2013/0200035 A1 Aug. 8, 2013

Related U.S. Application Data

(60) Provisional application No. 61/595,435, filed on Feb. 6, 2012.

(51) Int. Cl.

| | |
|---|---|
| ***B65D 41/04*** | (2006.01) |
| ***B65D 41/00*** | (2006.01) |
| ***B65B 69/00*** | (2006.01) |
| ***B65D 51/24*** | (2006.01) |

(52) U.S. Cl.

CPC ..... *B65D 41/00* (2013.01); *B65B 69/00* (2013.01); *B65D 41/04* (2013.01); *B65D 2203/00* (2013.01); *B65D 51/245* (2013.01)

USPC ..... 215/329; 215/316; 220/376; 53/492

(58) Field of Classification Search

CPC .... B65D 41/04; B65D 41/02; B65D 41/0471; B65D 2203/00; B65D 55/026; B65D 25/205

USPC ..... 215/316, 329, 230, 44, 43, 228; 220/293, 288, 376; 206/459.5; 53/492; 413/23; 40/307; D9/451, 435

See application file for complete search history.

(56) References Cited

U.S. PATENT DOCUMENTS

| | | | | | |
|---|---|---|---|---|---|
| 1,343,953 | A | * | 6/1920 | Wolters | 40/307 |
| 1,986,741 | A | | 1/1935 | Moser | |
| 1,987,902 | A | * | 1/1935 | Hofe | 40/307 |
| 2,040,381 | A | | 5/1936 | Hull | |
| 2,133,298 | A | * | 10/1938 | Kaufman | 220/288 |
| 2,418,353 | A | * | 4/1947 | Keith | 493/85 |
| 3,189,209 | A | * | 6/1965 | Owens | 215/329 |
| 4,231,480 | A | * | 11/1980 | Spransy | 215/329 |
| 4,856,668 | A | * | 8/1989 | Pfefferkorn et al. | 215/329 |
| 5,884,788 | A | * | 3/1999 | Wilde | 215/230 |
| 2004/0129665 | A1 | * | 7/2004 | Cavan | 215/228 |
| 2006/0138072 | A1 | * | 6/2006 | Mishra | 215/274 |
| 2012/0031871 | A1 | * | 2/2012 | Molinaro et al. | 215/44 |

* cited by examiner

*Primary Examiner* — Robert J Hicks

(74) *Attorney, Agent, or Firm* — Jeffrey Parry Intellectual Property Law Group PLLC; Jeffrey C. Parry

(57) ABSTRACT

An integrated canning jar lid configured to cover a mouth of a canning jar includes a closure portion, a top portion, and a skirt. The closure portion, top portion, and skirt may be integrated into a single device. The size and shape of the skirt may enhance the aesthetic appeal of the integrated lid as well as the convenience and ease of use. Embodiments of the integrated canning jar lid have a decorative element on the top thereof to further increase the aesthetic value of the lid and/or increase the convenience and ease of use.

14 Claims, 6 Drawing Sheets

INTEGRATED LID FOR CANNING JAR

CROSS-REFERENCE TO RELATED APPLICATIONS

This application claims priority under 35 USC §119 to U.S. Provisional Patent Application Ser. No. 61/595,435, filed on Feb. 6, 2012, and titled "Integrated Lid for Canning Jar," the entire contents of which are hereby incorporated by reference.

BACKGROUND

1. Technical Field

The present disclosure relates generally to a lid for a jar. More particularly, the disclosure relates to a lid for a canning jar. Canning jars may be known as Mason jars, fruit jars, jam jars, or Ball jars and are typically, but not necessarily, glass jars. The act of preserving food in a canning jar is commonly known as "canning" or "bottling."

2. Background

Preserving food in canning jars is a common method used for food preservation due to its relative ease, low-cost, and suitability for use in a typical home kitchen. Moreover, people may choose to preserve food by canning because this type of preservation may be accomplished without the use of artificial food preservative additives.

Typical implements used in canning include a canning jar, disc lid, and screw ring. Canning jars are made in a variety of sizes, including one cup, one pint, one quart, and one gallon. Two common jar opening sizes are wide mouth (having a diameter of roughly three inches) and small mouth (having a diameter of roughly two and three-eighth inches), also known as regular mouth. Canning jars include an external continuous screw thread closure around the rim of the mouth. A disc lid typically comprises a metal disc (however, some disc lids comprise other material, such as plastic) having an elastomeric washer or gasket bonded to the underside of it at or near its outer edge. The disc lid diameter typically has a slightly larger diameter than the mouth of the canning jar, such that the disc lid may rest over the canning jar opening and the elastomeric washer contacts and forms a seal with the rim of the canning jar mouth. A screw ring typically comprises threading that matches the continuous screw thread closure of the canning jar. The screw ring has an internal flange that applies a downward pressure to the disc lid when the screw ring has been secured to and tightened on the canning jar via the canning jar thread closure.

Canning may typically be performed to preserve fruits, vegetables, meats, or other food in a canning jar. A typical method of canning may include preparing food for canning, inserting the prepared food into a canning jar, placing a disc lid over the canning jar mouth, securing the disc lid to the canning jar mouth by threading a screw ring on the canning jar, placing the canning jar in boiling water or steam to sterilize the food within the canning jar, and cooling the canning jar. As the canning jar cools, a partial vacuum may form within the canning jar, thereby keeping the disc lid secured to the canning jar mouth and maintaining a seal. The screw ring may then be removed and the canning jar may be ready for storage.

After the canning process has been completed, some people desire to provide a decorative element to the canning jar. One popular method to decorate a canning jar is to drape a decorative piece of fabric over the canning jar and secure the fabric to the canning jar by wrapping and/or tying a rubber band, string, ribbon, or the like around the fabric at the canning jar closure threads. A portion of the fabric may overhang below the rubber band, string, ribbon, or the like such that the overhanging portion of the fabric forms a skirt. A screw ring may also be used to secure the fabric to the canning jar. Some people insert a batting or other type of filler between the disc lid and the fabric to increase the aesthetic nature of the completed canning jar.

The typical canning lid and fabric closure system as describe above may have some disadvantages. For example, if a canning jar has a decorative fabric secured to it, a person would unsecure and remove the fabric each time he or she desired to gain access to the contents of the canning jar, thus causing inconvenience to the person. Further inconvenience may be caused by the multiple components of the lid, which may include the disc lid, batting, decorative fabric, and ribbon (or the like). The removal of each component from the canning jar may cause further inconvenience to the person, such that the person might be discouraged from consuming the contents of the canning jar.

Another disadvantage is that spills may cause the decorative fabric to come into contact with the contents of the canning jar, thereby causing food stains and reducing the aesthetic appearance of the fabric.

A further disadvantage of the typical disc lid and fabric closure system is that people with arthritis or other disabilities may have a difficult time opening the canning jar if doing so requires the person to untie, unscrew, or otherwise remove the fabric from the canning jar. If a screw ring is used to secure the fabric to the canning jar, it may be difficult to grasp the screw ring and/or turn it with sufficient force to remove it. Such a disadvantage may reduce a person's independence if he or she is unable to gain access to the contents of the jar without outside assistance.

SUMMARY

The ideas presented in this disclosure are configured to overcome the above-described disadvantages. One embodiment of the present disclosure includes a canning lid having a closure portion, a skirt, and a top portion. The closure portion has an internal continuous screw thread closure. The closure portion is embedded within the top portion. The top portion and the skirt are integrated into a single device.

An additional embodiment of the present disclosure includes a method of removing a canning lid from a jar. The method of removing a canning lid from a jar includes setting at least one finger against a simulated skirt ridge on the canning lid, applying a turning force to the canning lid through the at least one finger to unscrew the canning lid from the jar, and removing the canning lid from the jar.

The present disclosure will now be described more fully with reference to the accompanying figures, which are intended to be read in conjunction with both this summary, the detailed description, and any preferred or particular embodiments specifically discussed or otherwise disclosed. This disclosure may, however, be embodied in many different forms and should not be construed as limited to the embodiments set forth herein; rather, these embodiments are provided by way of illustration only so that this disclosure will be thorough, and fully convey the full scope of the disclosure to those skilled in the art.

DETAILED DESCRIPTION

In the following description, reference is made to the accompanying figures that form a part thereof, and in which is shown by way of illustration specific exemplary embodiments in which the disclosure may be practiced. These embodiments are described in sufficient detail to enable those skilled in the art to practice the disclosure, and it is to be understood that modifications to the various disclosed embodiments may be made, and other embodiments may be utilized, without departing from the spirit and scope of the present disclosure. The following detailed description is, therefore, not to be taken in a limiting sense.

Figure 1:
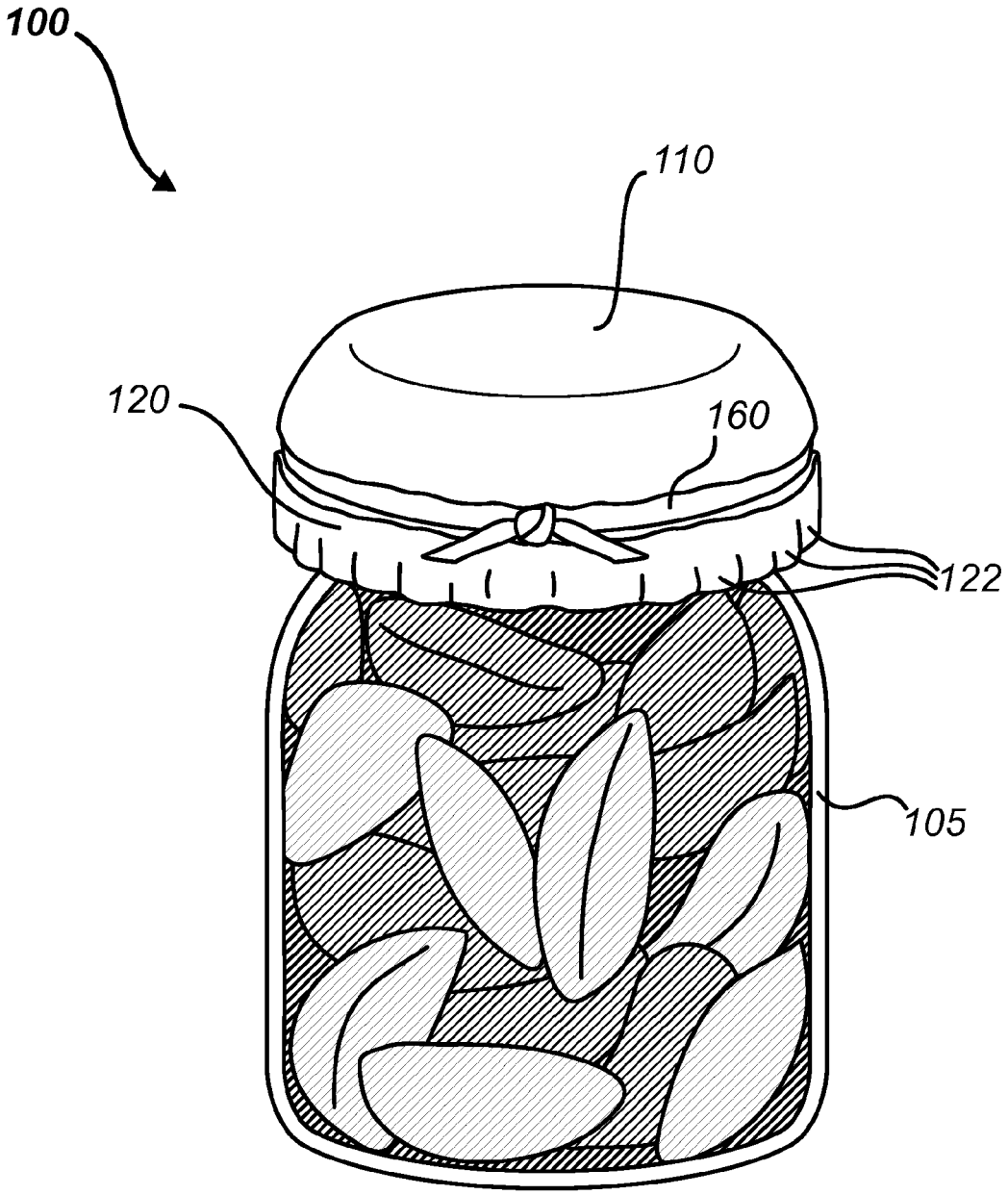
FIG. 1 depicts an embodiment of an integrated lid for a canning jar of the present disclosure secured to a canning jar.

To overcome certain deficiencies in the prior art, embodiments of the present disclosure comprise an integrated canning jar lid. Embodiments of the present disclosure may include a lid comprising decorative elements aesthetically similar to a traditional canning jar fabric skirt. The simulated skirt may be relative easy to grip when screwing and unscrewing the lid to a canning jar. With reference to FIG. 1, the integrated canning lid 100 may be used to provide a removable closure over the mouth of a canning jar 105. As depicted in FIG. 1, the integrated canning lid 100 has a top portion 110, a skirt 120, and a closure portion 130. In some embodiments, the top portion 110 is substantially flat as depicted in FIG. 1. In other embodiments the top portion 110 is rounded to mimic the rounded appearance of a canning jar fabric cover having batting or other filler. In the embodiment depicted, skirt 120 comprises wave-like ridges 122 to mimic the ruffled appearance of a fabric skirt. The ridges 122 may provide additional grip to a person attempting to screw or unscrew the integrated lid 100. As such, embodiments of the present embodiment comprise ridges 122 having troughs between each ridge 122 wide enough to partially receive a user's finger. The ridges 122 may accordingly allow a user to apply increased torque to the lid 100 in opening and closing the jar 105.

Figure 2:
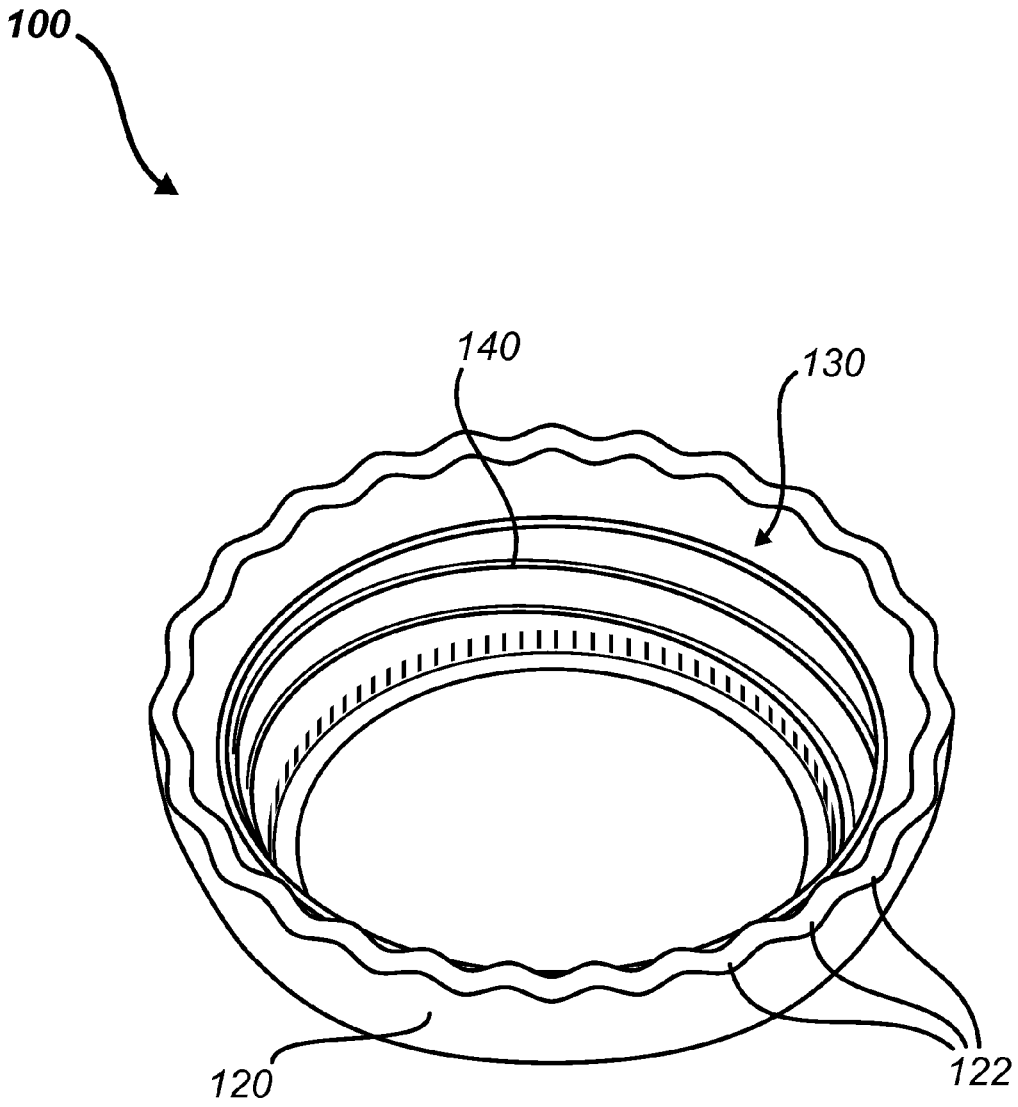
FIG. 2 shows an integrated closure portion of an embodiment of the present disclosure having a continuous screw thread closure.

As depicted in FIG. 2, the closure portion 130 comprises an internal continuous screw thread 140 that corresponds to a standard external thread closure of canning jars. The closure portion 130 may be adapted to fit over a mouth of a standard wide mouth canning jar or a standard small/regular mouth canning jar. Alternatively, the screw thread 140 may be customized to fit to virtually any sized canning jar mouth as may be desired. The screw thread 140 may comprise a metal (or other suitable material) portion embedded within and/or bonded to the integrated lid 100. In embodiments of the present disclosure, the closure portion 130 comprises food-grade steel. In alternative embodiments, the closure portion 130 comprises other suitable materials. Embodiments of the present disclosure may be manufactured by building decorative elements around a typical jar lid (such as one manufactured from metal or like material) having the desired closure and thread size so that the jar lid becomes embedded in an integrated lid 100. Alternatively, an integrated lid 100 may be manufactured by embedding a typical screw ring within the integrated lid 100.

Figure 3:
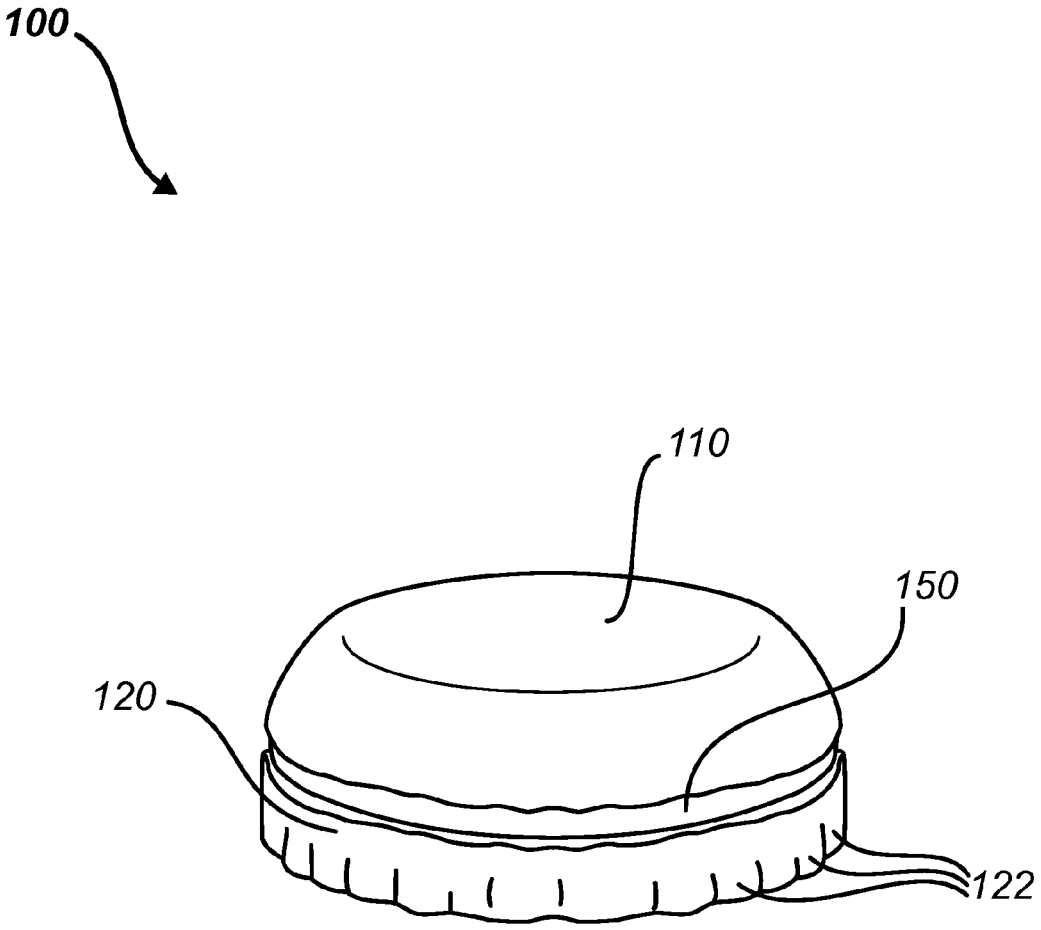
FIG. 3 depicts an embodiment of the integrated lid of the present disclosure comprising a groove for receiving a decorative ribbon.

Referring now to FIG. 3, embodiments of the present disclosure comprise groove 150 running around the skirt 120 of integrated lid 100. Referring back to FIG. 1, embodiments of the present disclosure comprise a ribbon 160 placed in groove 150 and wrapped around integrated lid 100. In embodiments, ribbon comprises a semi-permanent bow or other knot to enhance the aesthetic value of the lid 100. In embodiments, ribbon 160 has elastomeric properties that allow ribbon 160 to be stretched, placed into groove 150, and thereby maintained in place. Groove 150 has sufficient depth to allow placement of ribbon 160 therein and prevent the ribbon 160 from sliding down skirt 120.

Portions of the integrated canning lid 100 may be made of any suitable material that has the functional and aesthetic properties as described herein. In embodiments, the top portion 110 and skirt 120 are manufactured from polymer clay, glass, ceramic, polypropylene or other thermoplastic polymer, other plastic materials, or any other suitable material. Alternative embodiments of the present disclosure comprise multiple components joined together, with each component comprising different materials of manufacture. For example, the top portion 100 and skirt portion 120 may be made from polymer clay, while the lid closure portion is a metal lid embedded within the polymer clay.

Some considerations that affect the suitability of material of manufacture of the integrated lid 100 include the strength, durability, and weight of the material. The material is ideally strong and durable enough to withstand numerous cycles of removal and placement on the canning jar 105. The material is ideally light-weight enough that its use on a canning jar 105 does not make the canning jar 105 top-heavy or too heavy for a person to conveniently carry.

Figure 4:
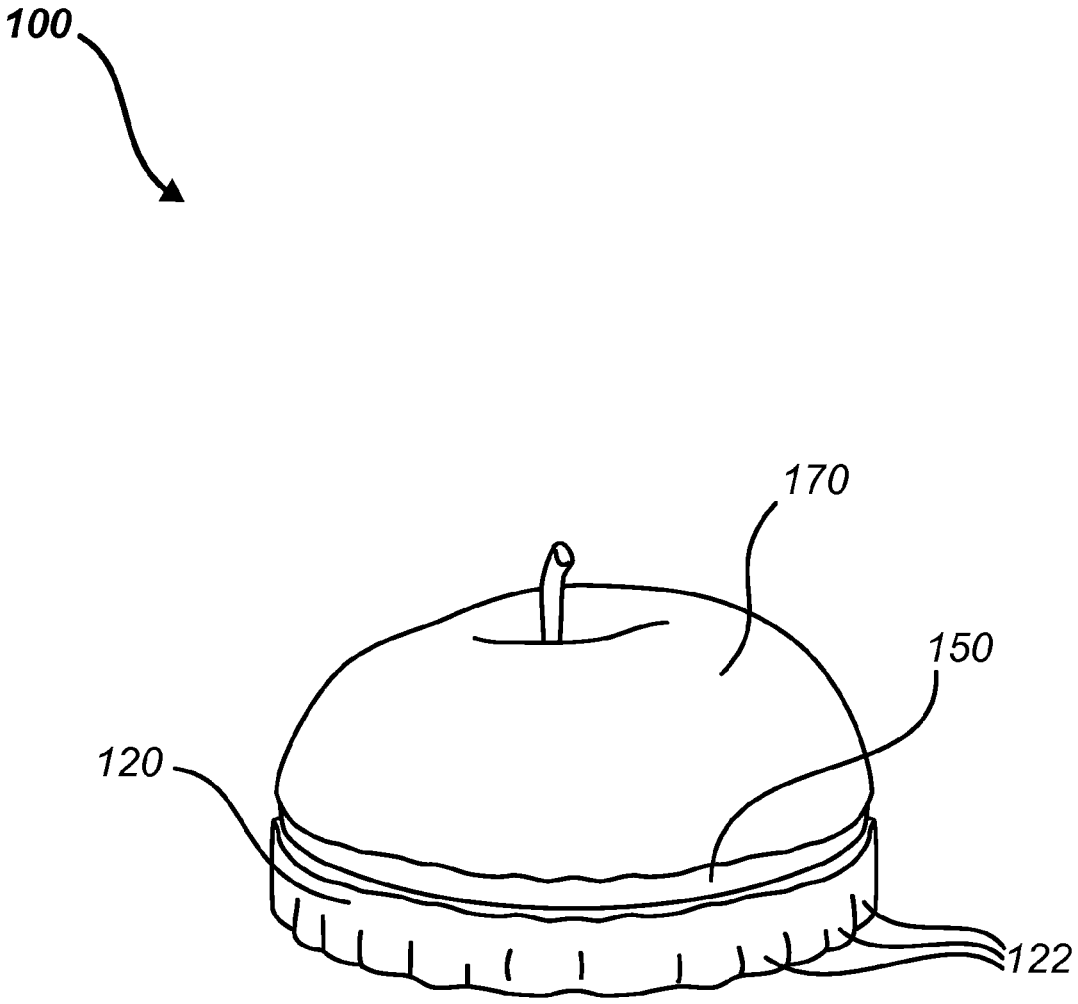
FIG. 4 depicts an embodiment of the integrated lid of the present disclosure comprising a decorative object thereon.

Referring now to FIG. 4, embodiments of the present disclosure include decorative element 170 on the top or sides of the integrated lid 100. For example, embodiments of the present disclosure have decorative element 170 placed at the top of the integrated lid, whereas such decorative elements may comprise various shapes and/or aesthetic designs incorporated into the lid. As depicted in FIG. 4, embodiments of the present disclosure comprise decorative element 170 that mimics the shape of an apple. Alternative embodiments comprise one or more decorative elements that mimic other fruits, animals, or other aesthetically-pleasing designs. Such a decorative element 170 may provide additional grip to a person opening the jar while enhancing the aesthetic appeal of the jar 105 and lid 100.

In alternative embodiments, the integrated canning lid 100 may include a decorative simulated ribbon 660 (depicted in FIG. 6) made of ceramic, plastic, or other polymer to further mimic a traditional fabric canning jar covering. The simulated ribbon may be made from the same material as the skirt.

In some embodiments, the ribbon 160 or simulated ribbon is color-coded to indicate the contents of the canning jar 105. In other embodiments, the integrated lid 100 itself, or other portions of it, are color-coded to indicate the contents. In other embodiments, the top portion 110 includes embossed and/or printed text to describe the contents of the canning jar 105.

In operation, a disc lid may be used to maintain a seal on a canning jar and preserve food therein. When the disc lid is removed and the seal is broken, an integrated lid 100 may be secured to the canning jar 105 to increase its aesthetic appeal and convenience of use. The integrated lid 100 may be removed from and replaced onto the canning jar 105 numerous times. After the canning jar 105 is empty, the integrated lid 100 may further be reused with other canning jars having the matching mouth diameter and thread specifications.

In other embodiments, the integrated lid 100 may be adapted to secure on a canning jar 105 and fit over a disc lid to provide the aforementioned aesthetic benefits even while the seal of the canning jar 105 has not been broken and the canning jar 105 is in storage. In this manner, one may gift a sealed canning jar 105 to another with the integrated lid 100 attached. After the disc lid has been removed, thereby breaking the seal, the integrated lid 100 may be secured to the canning jar 105 without the disc lid for short-term storage.

Figure 5:
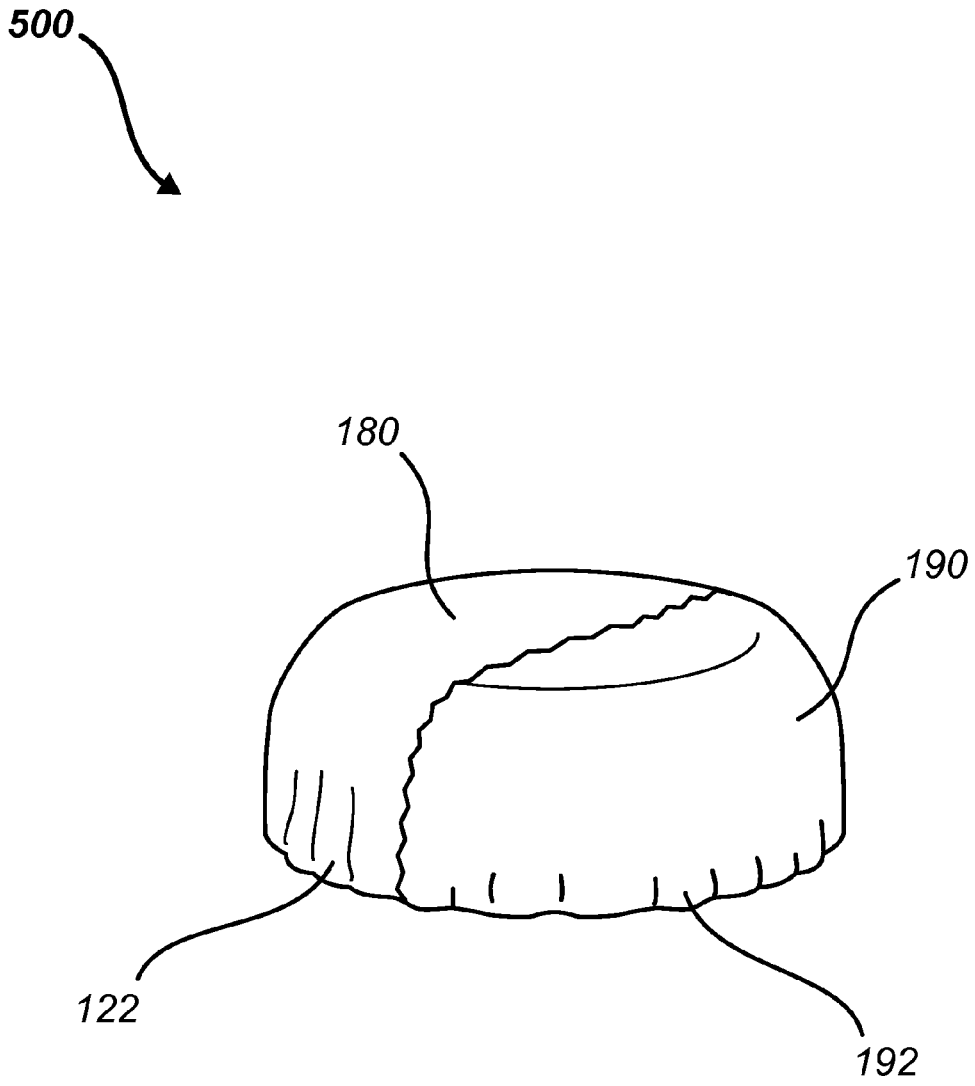
FIG. 5 depicts a step in the manufacturing process of an embodiment of the present disclosure.

Referring to FIG. 5, as will be understood by one of ordinary skill in the art having the benefit of this disclosure, an integrated lid 500 according to embodiments of this disclosure may be given its desired shape by draping a sheet of polymer clay 180 onto a mold 190 and forming ridge shapes 122, thereby making the skirt 120 have the appearance of fabric. In embodiments, mold 190 comprises ridges 192 to provide shape to ridges 122. Alternatively, a ceramic integrated lid may be manufactured by pouring the slip into a mold (such as a two-piece mold) that gives the lid a desired shape and form. Other typical manufacturing methods that are known in the art, such as injection molding, also fall under the scope of this disclosure.

Figure 6:
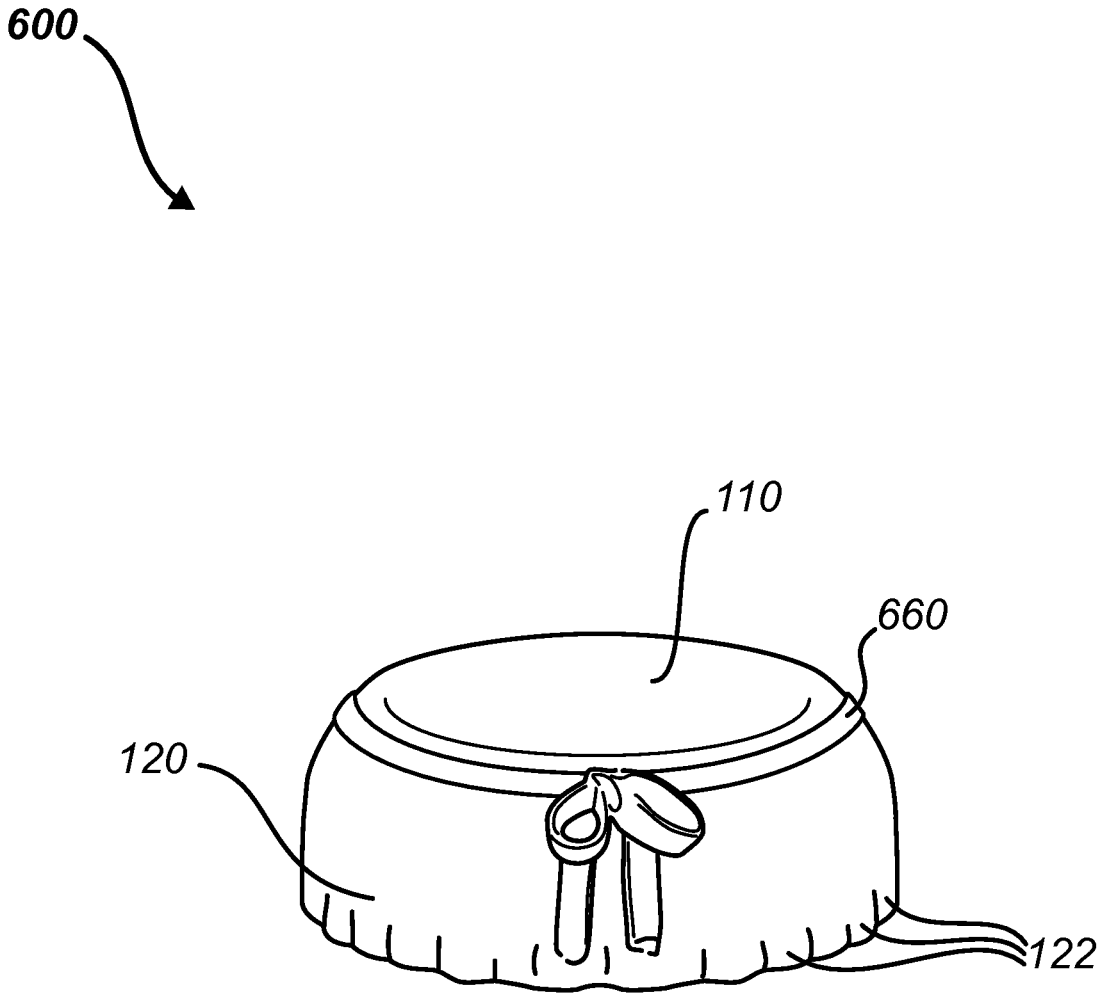
FIG. 6 depicts an embodiment of the integrated lid of the present disclosure comprising an integrated decorative ribbon incorporated thereon.

Referring to FIG. 6, an embodiment of the present disclosure comprises integrated lid 600 having an integrated simulated ribbon 660 incorporated therein. Ribbon 660 may be manufactured, sculpted, and/or molded from the same material as the other components 110, 120 of lid 600. For example, an embodiment comprising a ceramic lid 600 comprises ribbon 660 manufactured from the same ceramic. Alternatively, ribbon 660 may be manufactured from a different material than the body of lid 600. In embodiments, ribbon 660 is color-coded to the intended contents of a canning jar to provide a means for identifying the contents and/or for increasing the aesthetic nature of the lid 600.

Some benefits of the present system and method result from the ease of use and increased visual appeal of the integrated lid 100. The size and shape of the skirt and top portion allow for relatively easy removal from a canning jar 105. The ridges 122 may provide additional grip to a person attempting to open and/or close the integrated lid 105. A person may set his or her fingers against the ridges 122 of the integrated lid 100 and thereby apply increased torque for opening or closing the lid 100. The lack of certain traditional components, such as a separate disc lid, fabric piece, ribbon, and batting of traditional canning jar lids, may increase the convenience and ease of use of the integrated lid 105.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the spirit and scope of the present disclosure.

What is claimed is:

1. A canning lid comprising:
- a closure portion comprising an internal continuous screw thread closure;
- a lid opening;
- a simulated fabric skirt comprising multiple outward-facing, rounded, and annularly spaced skirt ridges, the skirt ridges being essentially perpendicular to the lid opening; and
- a top portion;
- wherein the closure portion is embedded within the top portion; and
- wherein the top portion and the skirt are integrated into a single device.

2. The canning lid of claim 1, wherein the top portion and skirt are manufactured from ceramic.

3. The canning lid of claim 1, wherein the top portion and skirt are manufactured from glass.

4. The canning lid of claim 1, wherein the top portion and skirt are manufactured from polymer clay.

5. The canning lid of claim 1, wherein the top portion and skirt are manufactured from a thermoplastic polymer.

6. The canning lid of claim 1, wherein the top portion and skirt are manufactured from a plastic material.

7. The canning lid of claim 1, further comprising an annular groove around the canning lid.

8. The canning lid of claim 7, further comprising a ribbon in the groove.

9. The canning lid of claim 1, further comprising a simulated ribbon.

10. The canning lid of claim 9, wherein the simulated ribbon is color-coordinated for a food.

11. The canning lid of claim 1, further comprising a decorative element rigidly mounted to the top portion.

12. The canning lid of claim 11, wherein the decorative element comprises a fruit shape.

13. The canning lid of claim 11, wherein the decorative element comprises an animal shape.

14. A method of removing a canning lid from a jar, wherein the canning lid comprises:
- a closure portion comprising an internal continuous screw thread closure;
- a lid opening;
- a simulated fabric skirt comprising multiple outward-facing, rounded, and annularly spaced skirt ridges, the skirt ridges being essentially perpendicular to the lid opening; and
- a top portion;
- wherein:
  - the closure portion is embedded within the top portion; and
  - wherein the top portion and the skirt are integrated into a single device;
- the method comprising:
- setting at least one finger against one of the skirt ridges on the canning lid;
- applying a turning force to the canning lid through the at least one finger to unscrew the canning lid from the jar; and
- removing the canning lid from the jar.

* * * * *